US005957710A

United States Patent [19]

Nagano

[11] Patent Number: 5,957,710

[45] Date of Patent: Sep. 28, 1999

[54] LIF CONNECTOR

[75] Inventor: Toru Nagano, Shizuoka, Japan

[73] Assignee: Yazaki Corporation, Tokyo, Japan

[21] Appl. No.: 09/020,283

[22] Filed: Feb. 9, 1998

[30] Foreign Application Priority Data

Mar. 3, 1997 [JP] Japan ..... 9-047805

[51] Int. Cl.[6] ..... H01R 13/62

[52] U.S. Cl. ..... 439/157

[58] Field of Search ..... 439/152–160, 439/352, 357

[56] References Cited

U.S. PATENT DOCUMENTS

| | | | |
|---|---|---|---|
| 5,727,959 | 3/1998 | Yagi et al. | 439/157 |
| 5,810,612 | 9/1998 | Flask et al. | 439/157 |
| 5,823,809 | 10/1998 | Wakata | 439/157 |

FOREIGN PATENT DOCUMENTS 5-129048 5/1993 Japan .

*Primary Examiner*—Khiem Nguyen

*Attorney, Agent, or Firm*—Sughrue, Mion, Zinn, Macpeak & Seas, PLLC

[57] ABSTRACT

A LIF connector includes a frame member (10) having a pivotally-movable lever member (20), and first and second connectors (30 and 40, 50) to be fitted together through the frame member (10). The lever member (20) is provisionally retained when setting the first connector (30) on the frame member (10). Bendable provisionally-retaining arms (23) are provided respectively on side walls of the lever member (20), and arm reception portions (12) are mounted in a projected manner on inner surfaces of side walls of the frame member (10), respectively, and the arm reception portion (12) can retain the provisionally-retaining arm (23) to provisionally retain the lever member (20) in such a manner that the arm reception portion (12) provides a space for allowing the bending of the provisionally-retaining arm (23). A retainment release rib (32) is mounted in a projected manner on an outer surface of a side wall of the first connector, and this rib bends the provisionally-retaining arm (23) to release the retaining engagement of the arm (23) with the arm reception portion (12) when the first connector (30) is set on the frame member (10).

20 Claims, 6 Drawing Sheets

LIF CONNECTOR

BACKGROUND OF THE INVENTION

1. Field of the Invention

This invention relates to an LIF (low insertion force) connector having a lever member by which male and female connectors (multi-pole connectors) each having many terminals are fitted together with a low insertion force, and more particularly to such an LIF connector in which the lever member can be provisionally retained satisfactorily.

2. Background

In an LIF connector having a lever member, cam pins, formed on one of male and female connectors, are introduced respectively into cam grooves formed in the other connector, and the one connector is set on the other connector, and in this condition, the lever member is pivotally moved, thereby fitting the two connectors together with a low insertion force.

In one type of such LIF connector, when one of the male and female connectors is to be set on the other connector, the lever member is provisionally retained so as to position the cam grooves with respect to the cam pins.

A conventional LIF connector designed to provisionally retain a lever member, will now be described with reference to the drawings.

FIG. 5 shows an exploded, perspective view of the LIF connector proposed in Unexamined Japanese Patent Publication No. Hei. 5-129048. FIG. 6*a* is a side-elevational view showing a provisionally-retained condition of the LIF connector, and FIG. 6*b* is a side-elevational view showing a condition in which the provisionally-retained condition of the LIF connector is released.

In FIG. 5, a housing 111 of a female connector 110 has a reception portion 112 for a male connector 130. Vertical grooves 113 are formed respectively in opposite side walls forming the reception portion 112, and a pivot shaft 114 is formed immediately below each of the vertical grooves 113.

A lever member 120 (more fully described later) is pivotally mounted on the pivot shafts 114 through through holes 121, and as shown in FIG. 6*a,* a provisionally-retaining projection 115 is formed on an upper end portion of one of the opposite side walls of the housing 111, and can retainingly engage a distal end 120*a* of one of opposed side walls of the lever member 120 to thereby retain the lever member 120 in a provisionally-retained condition.

As shown in FIG. 5, a vertical notch 116 is formed in the one side wall of the housing 111, and is disposed between the vertical groove 113 and the provisionally-retaining projection 115.

A disengagement prevention portion 117 for preventing the disengagement of the lever member 120 is formed on the one side wall of the housing 111, and covers the provisionally-retaining projection 115 and the notch 116.

Cam grooves 122 are formed respectively in the opposed side walls of the lever member 120, and intersect the vertical grooves 113 in the female connector 110, respectively.

The male connector 130 includes a housing 131 of a rectangular shape corresponding to the reception portion 112 of the female connector 110, and cam pins 132, which can be guided by the vertical grooves 113 and the cam grooves 122, are formed respectively on opposite side walls of the housing 131.

A retainment release rib 133, corresponding to the notch 116 in the female connector 110, is formed on one of the opposite side walls of the housing 131.

The operation for fitting the male and female connectors of this conventional LIF connector together will be described with reference to FIGS. 6*a* and 6*b*.

As shown in FIG. 6*a,* when the distal end 120*a* of the one side wall of the lever member 120 is retained by the provisionally-retaining projection 115 of the female connector 110, the lever member 120 is held in the provisionally-retained condition.

In this provisionally-retained condition, open ends of the cam grooves 122 in the lever member 120 coincide respectively with open ends of the vertical grooves 113 in the female connector 110, and these open ends are positioned with respect to the associated cam pins 132 on the male connector 130.

Then, as shown in FIG. 6*b,* the cam pins 132 are introduced into the open ends of the associated cam grooves 122 and vertical grooves 113, and the male connector 130 is set on the female connector 110.

Accordingly, the retainment release rib 133 of the male connector 130 is introduced into the notch 116 in the female connector 110, and outwardly forces the distal end 120*a* of the lever member 120 retained by the provisionally-retaining projection 115.

Accordingly, the retaining engagement of the distal end 120*a* with the provisionally-retaining projection 115 is released (that is, the provisionally-retained condition of the lever member 120 is released), so that the lever member 120 can be pivotally moved.

Thereafter, when the lever member 120 is pivotally moved in a direction of arrow P shown in FIG. 6*b,* each cam pin 132 is moved along the associated cam groove 122 and vertical groove 113, so that the male connector 130 is fitted into the female connector 110.

However, in the above conventional LIF connector, the distal end 120*a* of the lever member 120 is forced outwardly by the retainment release rib 133 of the male connector 130, thereby releasing the retaining engagement of the distal end 120*a* with the provisionally-retaining projection 115. Therefore, the outwardly-forced distal end 120*a* deforms the disengagement prevention portion 117 disposed at the outermost peripheral portion of the female connector 110.

Accordingly, there is a disadvantage that a fixing portion for being fixed to a vehicle or the like can not be provided on the disengagement prevention portion 117 disposed at the outermost peripheral portion which is the optimum position for mounting this fixing portion.

Furthermore, if the fixing portion for being fixed to the vehicle or the like is mounted on the disengagement prevention portion 117 which can be thus deformed, the disengagement prevention portion 117 or the distal end 120*a* of the lever member 120 may be damaged by stresses as a result of repeated operation of the lever member 120.

OBJECTS OF THE INVENTION

The present invention has been made in view of the above problems, and an object of the invention is to provide an LIF connection in which the provisional retaining of a lever member can be effected and released positively and smoothly without deforming any member irrelevant to the provisional retaining of the lever member, and also a fixing portion for being fixed to a vehicle or the like can be provided without any limitation, and further the connector fitting and disconnecting operations can be effected continuously and smoothly.

SUMMARY OF THE INVENTION

To achieve the above-mentioned objects, an LIF connector comprises: first and second connectors fittable to each other; a lever member pivotally mounted on the second connector, the lever member being set in a provisionally retaining condition before setting the first connector on the second connector; a bendable provisionally-retaining arm formed on one of an inner surface of a side wall of the second connector and a side wall of the lever member; an arm reception portion formed on the other one of the inner surface of the side wall of the second connector and the side wall of the lever member, the arm reception portion retainable the provisionally-retaining arm so as to provisionally retain the lever member, the arm reception portion having a space which is allowable the bending of the provisionally-retaining arm; and a retainment release rib formed on an outer surface of a side wall of the first connector, the retainment release rib bendable the provisionally-retaining arm to release the retaining engagement of the provisionally-retaining arm with the arm reception portion when the first connector is set on the second connector.

To further achieve the above-mentioned objects, an LIF connector comprises: a frame member receivable a second connector; a lever member pivotally mounted on the frame member; a first connector fittable to the second connector through the frame member, in which the lever member is set in a provisionally retaining condition before setting the first connector on the frame member; a bendable provisionally-retaining arm formed on one of an inner surface of a side wall of the frame member and a side wall of the lever member; an arm reception portion formed on the other one of the inner surface of the side wall of the frame member and the side wall of the lever member, the arm reception portion retainable the provisionally-retaining arm so as to provisionally retain the lever member, the arm reception portion having a space which is allowable the bending of the provisionally-retaining arm; and a retainment release rib formed on an outer surface of a side wall of the first connector, the retainment release rib bendable the provisionally-retaining arm to release the retaining engagement of the provisionally-retaining arm with the arm reception portion when the first connector is set on the frame member.

In the above-mentioned LIF connectors, preferably, the provisionally-retaining arm includes a bendable plate-like arm body, a lock pawl formed at a distal end of the arm body, and an abutment portion formed on a front surface of the arm body so as to engage the retainment release rib, and the arm reception portion includes two retaining piece portions having an L-shaped cross-section and an inverted L-shaped cross-section, and the two retaining piece portions form the space for receiving the arm body, and also form a gap for exposing the abutment portion to the exterior.

In the LIF connector of this construction according to the invention, when the provisionally-retaining arm of the lever member is retainingly engaged in the arm reception portion of the second connector (or the frame member) at the inside of the side wall of the second connector (or the frame member), the lever member is held in the provisionally-retained condition.

More specifically, the arm body is inserted into the space formed by the two retaining piece portions of the arm reception portion, and as a result the lock pawl is retained by these retaining piece portions, and also the abutment portion is fitted in the gap between the retaining piece portion, thereby holding the lever member in the provisionally-retained condition.

In this provisionally-retained condition, cam grooves in the lever member are positioned relative to cam pins of the first connector, respectively.

Then, each cam pin of the first connector is introduced into an open end of the associated cam groove in the lever member, and the first connector is set on the second connector (or the frame member). During this setting operation, the retainment release rib of the first connector presses the abutment portion of the provisionally-retaining arm, thereby bending or deforming the provisionally-retaining outwardly.

Since the space for allowing the bending of the provisionally-retaining arm is provided in the space formed by the retaining piece portions, the provisionally-retaining arm thus bent will not engage the side wall of the second connector (or the frame member).

When the provisionally-retaining arm is thus bent outwardly by the retainment release rib, the retaining engagement of the lock pawl with the retaining piece portions is released, so that the lever member can be pivotally moved.

Thereafter, when the lever member is pivotally moved, each cam pin moves along the associated cam groove, so that the first connector is fitted relative to the second connector.

Preferably, slanting guide surfaces for guiding the lock pawl of the provisionally-retaining arm into the space, as well as slanting guide surfaces for guiding the abutment portion into the gap, may be formed on inner edges of the two retaining piece portions of the arm reception portion. Furthermore, a slanting guide surface for sliding contact with the inner edges of the retaining piece portions to guide the lock pawl into the space may be formed at a distal end of the lock pawl of the provisionally-retaining arm.

Where the slanting guide surfaces as recited above are provided, the lock pawl and abutment portion of the provisionally-retaining arm can be positively and smoothly inserted respectively into the space and the gap, formed by the retaining piece portions of the arm reception portion, when provisionally retaining the lever member.

Furthermore, a slanting guide surface for sliding contact with the retainment release rib so as to guide the retainment release rib to the abutment portion may be formed at an end of the abutment portion of the provisionally-retaining arm.

Where the slanting guide surface as recited above is provided, the retainment release rib can be smoothly brought into engagement with the abutment portion of the provisionally-retaining arm when setting the first connector, and the provisionally-retained condition of the lever member can be positively released.

Furthermore, a slanting guide surface for sliding contact with the distal end of the lock pawl of the provisionally-retaining arm so as to guide the retainment release rib to the abutment portion of the provisionally-retaining arm may be formed on the retainment release rib.

Where the slanting guide surface as recited above is provided, the retainment release rib smoothly slides over the provisionally-retaining arm when disconnecting the first connector, and therefore the first connector can be easily disconnected.

DETAILED DESCRIPTION OF THE PREFERRED EMBODIMENT

One preferred embodiment of an LIF connector of the present invention will now be described with reference to the drawings.

The LIF connector of this embodiment, which will be described below, comprises first and second connectors to be fitted together, and a frame member having a pivotally-movable lever member, and the first and second connectors are fitted together through the frame member.

In the LIF connector of this embodiment, the first connector is a male connector, and the second connectors are female connectors.

Figure 1A:
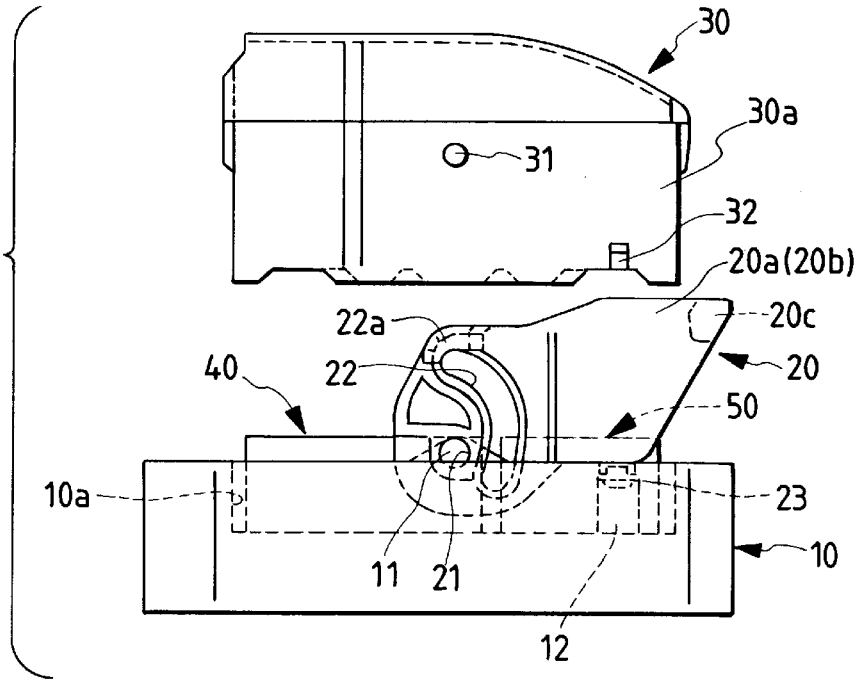
FIGS. 1*a* and 1*b* show a preferred embodiment of an LIF connector of the present invention, FIG. 1*a* being a side-elevational view showing a provisionally-retained condition, and FIG. 1*b* being a side-elevational view showing a condition in which the provisional retaining is released.

In FIG. 1*a,* the frame member 10 is made of a synthetic resin or the like, and includes a connector reception portion 10*a* for receiving the male connector 30 and the female connectors 40 and 50 which are fitted together.

Outwardly-projecting pivot shafts 11 and 11 are formed respectively on central portions of upper edges of opposite side walls of the frame member 10, and the arm reception portions 12 and 12 are formed respectively on inner surfaces of one end portions of the opposite side walls.

Figure 2A:
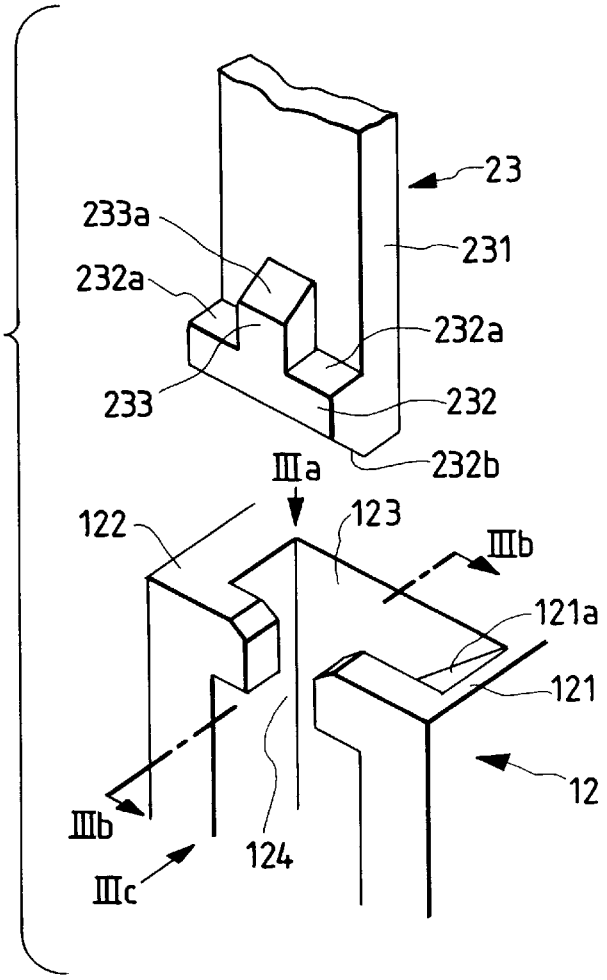
FIGS. 2*a* and 2*b* show an operation for retainingly engaging a provisionally-retaining arm and an arm reception portion of the LIF connector with each other, FIG. 2*a* being an enlarged view showing a condition before the retaining engagement is effected, and FIG. 2*b* being an enlarged view showing a condition in which the retaining engagement is effected.

As shown in FIG. 2*a,* the arm reception portion 12 includes two opposed retaining piece portions 121 and 122 of an inverted L-shape having an L-shaped cross-section, and these portions 121 and 122 form a space 123 and a gap 124 continuous therewith.

Figure 3A:
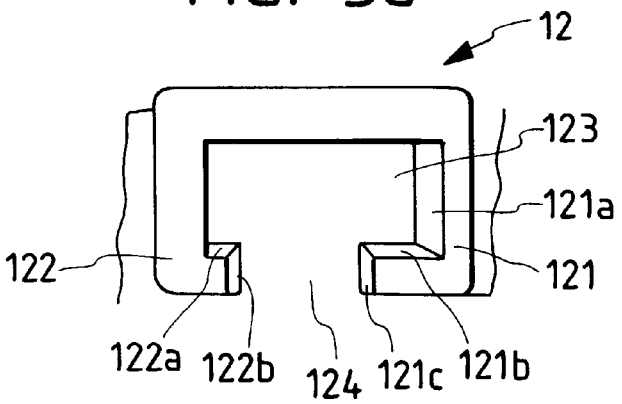
FIGS. 3*a,* 3*b* and 3*c* show the arm reception portion, FIG. 3*a* being a view as seen in a direction of arrow IIIa of FIG. 2*a,* FIG. 3*b* being a cross-sectional view taken along the line IIIb—IIIb of FIG. 2*a,* and FIG. 3*c* being a view as seen in a direction of arrow IIIc of FIG. 2*a;*
Figure 3B:
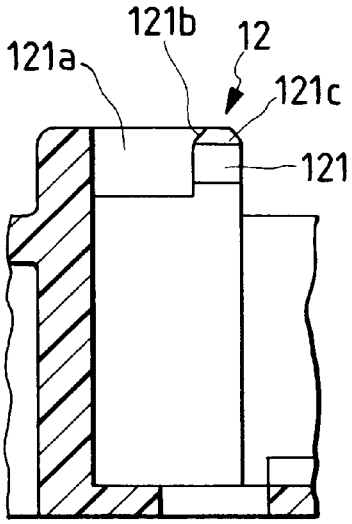
Figure 3C:
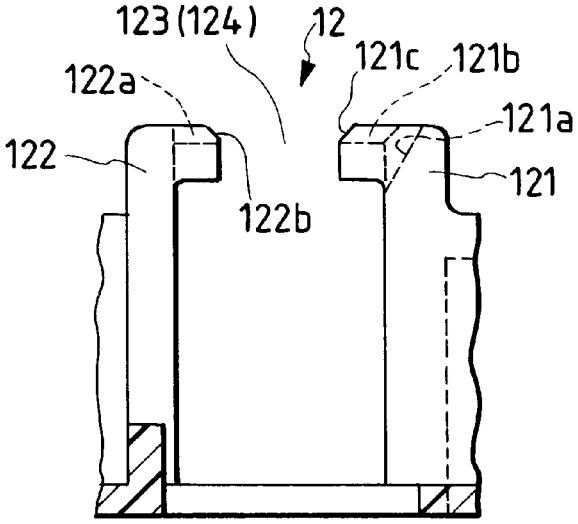

As shown in FIGS. 3*a,* 3*b* and 3*c,* slanting guide surfaces 121*a* and 121*b* slanting toward the space 123, as well as a slanting guide surface 121*c* slanting toward the gap 124, are formed on one retaining piece portion 121. A slanting guide surface 122*a,* slanting toward the space 123, and a slanting guide surface 122*b,* slanting toward the gap 124, are formed on the other retaining piece portion 122.

Although not shown in the drawings, the frame member 10 has a holding structure for holding the female connectors 40 and 50 in the connector reception portion 10*a.*

In FIG. 1*a,* the lever member 20 includes side walls 20*a* and 20*b* made of a synthetic resin or the like, and an operating portion (connecting portion) 20*c* extending between the side walls 20*a* and 20*b.* Through holes 21 and 21 are formed respectively through end portions of the two side walls 20*a* and 20*b* remote from the operating portion 20*c,* and the lever member 20 is pivotally mounted on the pivot shafts 11 and 11 of the frame member 10 through the through holes 21 and 21.

Arcuate cam grooves 22 and 22 are formed respectively in the end portions of the opposite side walls 20*a* and 20*b* remote from the operating portion 20*c,* and are disposed adjacent respectively to the through holes 21 and 21. Upper ends of the cam grooves 22 and 22 are open as at 22*a,* and can receive cam pins 31 and 31 of the male connector 30, respectively.

The provisionally-retaining arms 23 and 23 are integrally formed respectively on inner surfaces of lower end portions of the opposite side walls 20*a* and 20*b* disposed close to the operating portion 20*c*. As shown in FIG. 2*a,* the provisionally-retaining arm 23 includes a bendable (deformable) plate-like arm body 231 for being inserted into the space 123 in the arm reception portion 12, a lock pawl 232 which is formed integrally at a distal end of the arm body 231, and retainingly engages the retaining piece portions 121 and 122 when the arm body 213 is inserted into the space 123, and an abutment portion 233 which is formed integrally with the arm body 231, and is fitted into the gap 124 when the arm body 231 is inserted into the space 123, and the abutment portion 233 can abut against a retainment release rib 32 (described later).

The width of the arm body 231 is generally equal to the width of the space 123 in the arm reception portion 12.

Figure 4C:
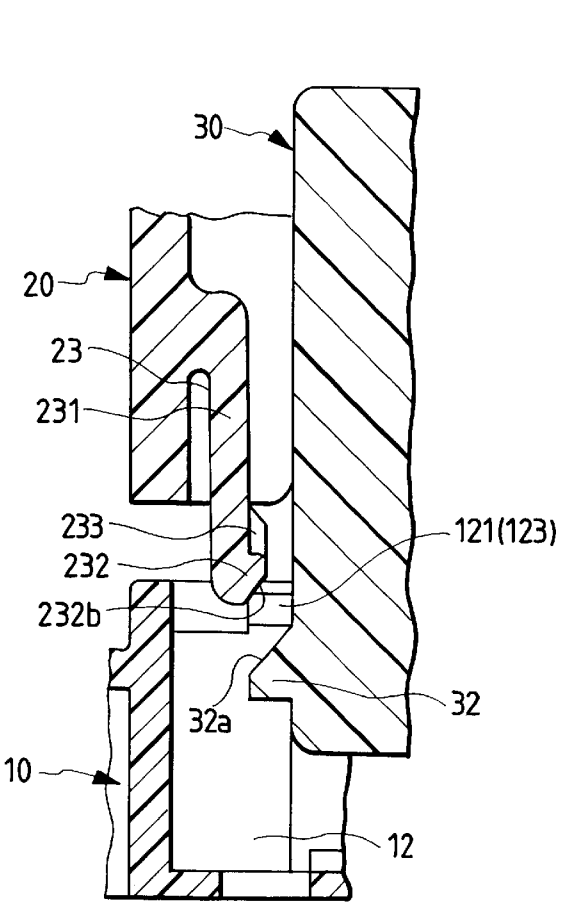
FIGS. 4*a,* 4*b* and 4*c* show an operation for releasing the retaining engagement between the provisionally-retaining arm and the arm reception portion, FIG. 4*a* being a cross-sectional view showing a condition in which the retaining engagement is effected, FIG. 4*b* being a cross-sectional view showing a condition in which the retaining engagement is to be released, and FIG. 4*c* being a cross-sectional view showing a condition in which the retaining engagement is effected.
Figure 4B:
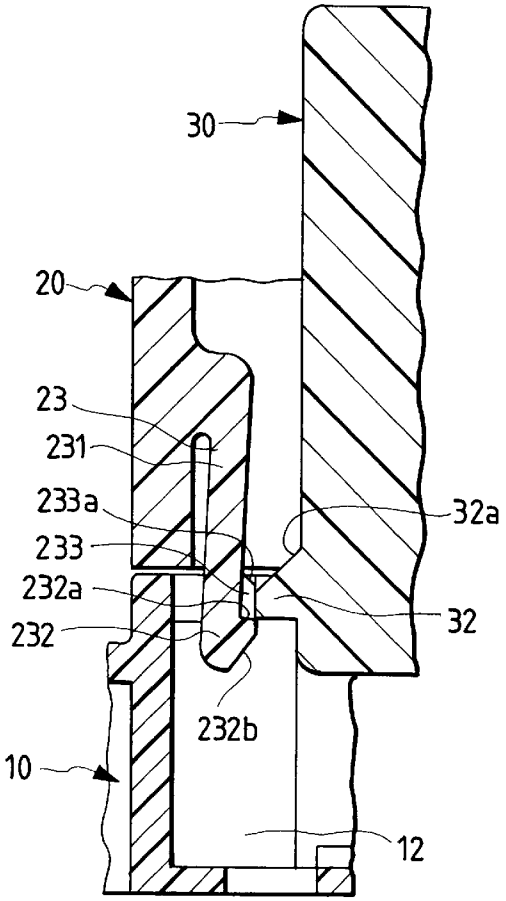
Figure 4A:
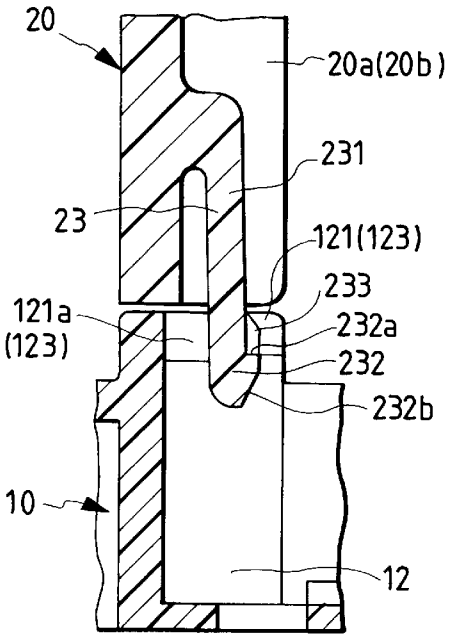
Figure 5:
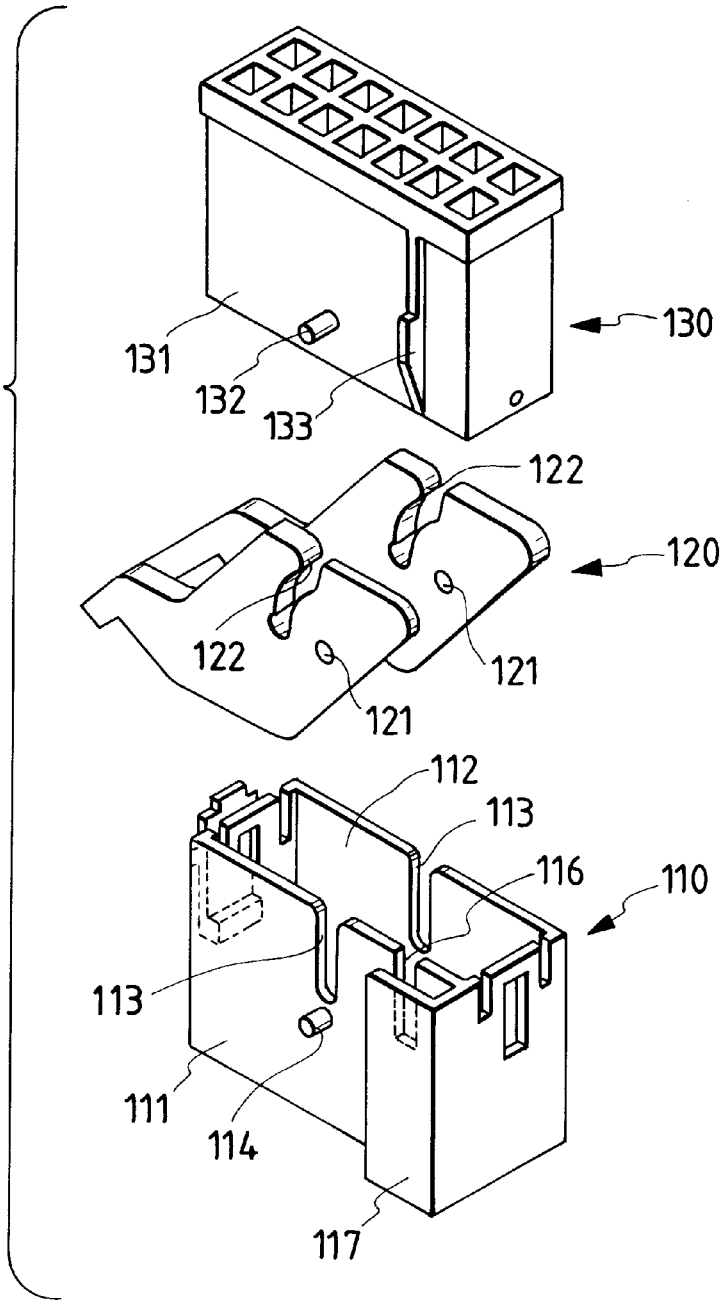
FIG. 5 PRIOR ART
FIG. 5 is an exploded, perspective view of an LIF connector proposed in Unexamined Japanese Patent Publication No. Hei. 5-129048.
Figure 6A:
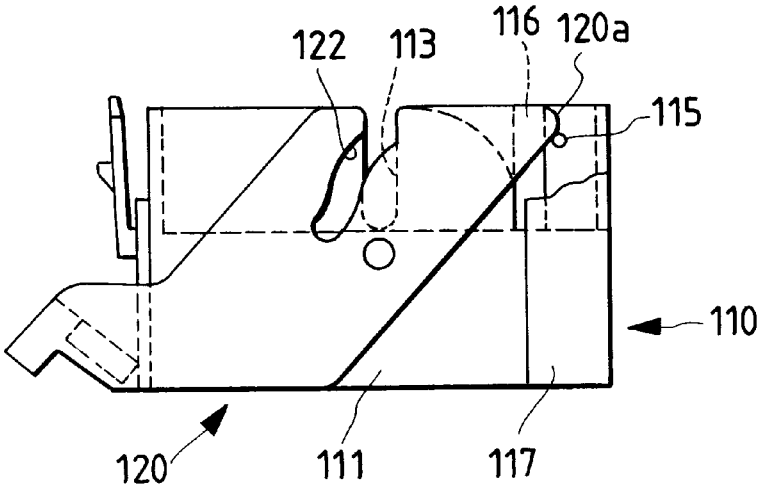
FIG. 6a PRIOR ART
FIG. 6*a* is a side-elevational view showing a provisionally-retained condition of the above conventional LIF connector.
Figure 6B:
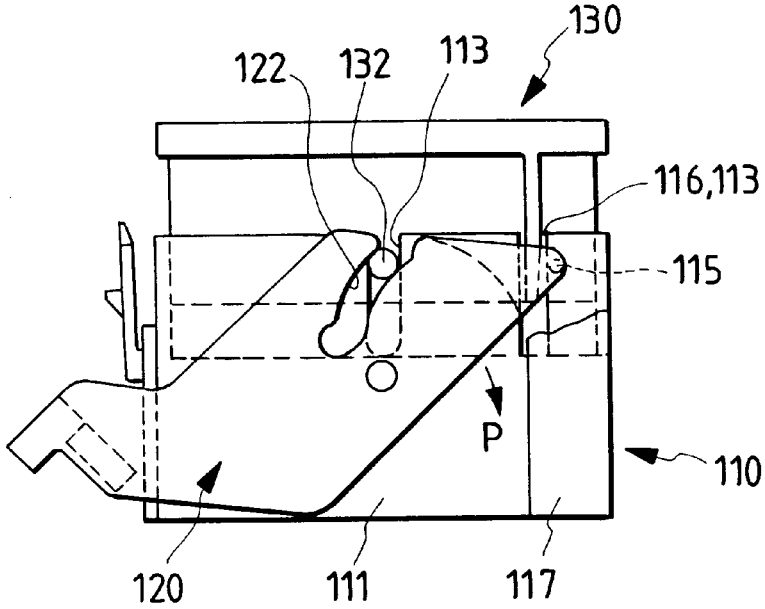
FIG. 6b PRIOR ART
FIG. 6*b* is a side-elevational view showing a condition in which the provisionally-retained condition of the conventional LIF connector is released.

As shown in FIG. 4*a,* the thickness of the arm body 231 is smaller than the depth of the space 123 in the arm reception portion 12, and in other words the depth of the space 123 in the arm reception portion 12 is larger than the thickness of the arm body 231. With this construction, a space for allowing the deformation of the arm body 231 is provided in the space 123.

Therefore, the arm body 231, inserted into the space 123, can be bent or deformed in the space 123 without contact with the side wall of the frame member 10.

An upper surface of the lock pawl 232, disposed perpendicular to the arm body 231, provides retaining surfaces 232*a* and 232*a* for retaining engagement with the retaining piece portions 121 and 122, respectively. A slanting guide surface 232*b* is formed on the distal end of the lock pawl 232, and can be brought into sliding contact with inner edges of the retaining piece portions 121 and 122 so as to guide the lock pawl 232 into the space 123.

The abutment portion 233 is generally equal in width and thickness to the gap 124 in the arm reception portion 12, and a slanting guide surface 233*a* is formed on an upper end of the abutment portion 233, and can be brought into sliding contact with the retainment release rib 32 so as to guide the same to the abutment portion 233.

The lever member 20 can be pivotally moved in opposite directions by holding the operation portion 20*c* with the hand, and in the condition shown in FIG. 1*a,* the provisionally-retaining arms 23 and 23 are provisionally retained in the arm reception portions 12 and 12, respectively.

In FIG. 1*a,* the cam pins 31 and 31 are formed respectively on central portions of opposite side walls of a housing 30*a* of the male connector 30, and the retainment release ribs 32 and 32 are formed respectively on those portions of these opposite side walls corresponding respectively to the retaining arms 23 and 23.

The cam pin 31 has a diameter generally equal to the width of the cam groove 22 in the lever member 20, and has a height generally equal to the depth of the cam groove 22.

As shown in FIG. 4*b*, a slanting guide surface 32*a* is formed on the retainment release rib 32, and when disconnecting the male connector 30, this guide surface 32*a* is brought into sliding contact with the distal end of the lock pawl 232 of the provisionally-retaining arm 23 so as to guide the retainment release rib 32 to the abutment portion 233 of the provisionally-retaining arm 23.

Although not shown in the drawings, many female terminals are received within the housing 30*a* of the male connector 30, and many male terminals, corresponding respectively to these female terminals, are received within housings of the female connectors 40 and 50.

The operation for fitting the male and female connectors of the LIF connector of this embodiment will be now be described with reference to the drawings.

First, as shown in FIG. 1*a*, the female connectors 40 and 50 are fitted into the connector reception portion 10*a* of the frame member 10, and then the lever member 20 is pivotally moved, the provisionally-retaining arms 23 are retainingly engaged respectively in the arm reception portions 12 inside the frame member 10. Accordingly, the lever member 20 is held in a provisionally-retained condition.

Figure 2B:
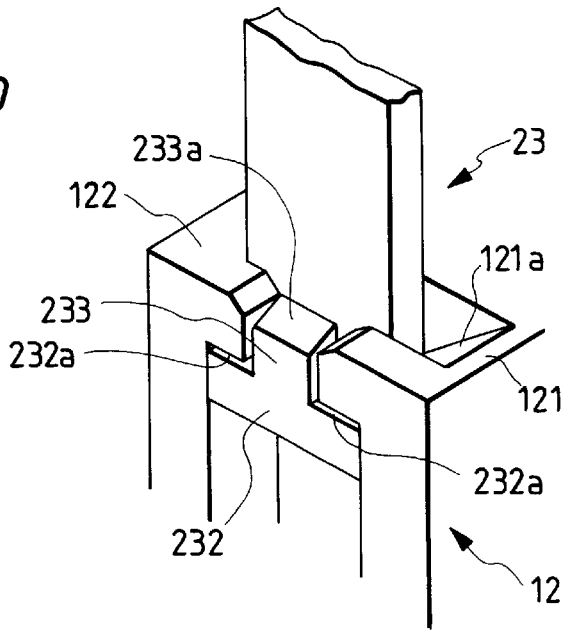

More specifically, as shown in FIGS. 2*a*, 2*b* and 4*a*, the arm body 231 of the provisionally-retaining arm 23 is inserted into the space 123 formed by the retaining piece portions 121 and 122 of the arm reception portion 12, and the retaining surfaces 232*a* and 232*a* of the lock pawl 232 are retained respectively by the retaining piece portions 121 and 122. At this time, the abutment portion 233 of the provisionally-retaining arm 23 is fitted into the gap 124 between the retaining piece portions 121 and 122, and is kept exposed to the exterior.

In the provisionally-retained condition of the lever member 20, the open ends 22*a* of the cam grooves 22 in the lever member 20 are positioned relative to the cam pins 31 of the male connector 30, respectively.

Figure 1B:
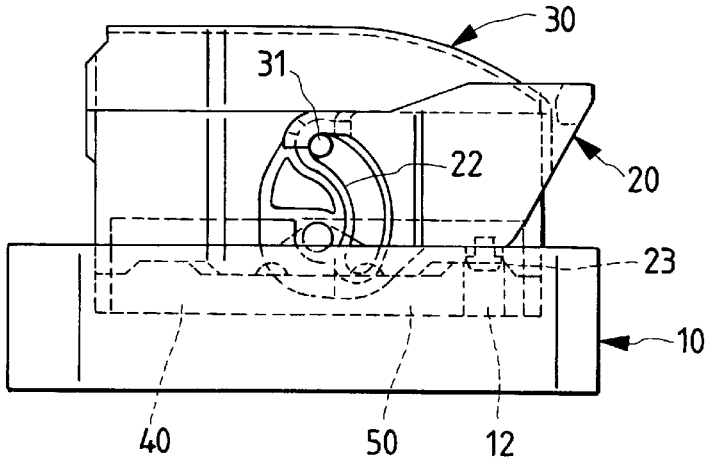

Then, as shown in FIG. 1*b*, each cam pin 31 is introduced into the open end 22*a* of the associated cam groove 22, and the male connector 30 is set on the connector reception portion 10*a* of the frame member 10. During this setting operation, each retainment release rib 32 of the male connector 30 is guided to the abutment portion 233 of the associated provisionally-retaining arm 23 by the slanting guide surface 233*a*, and presses the abutment portion 233, thereby bending or deforming the provisionally-retaining arm 23 outwardly, as shown in FIG. 4*b*.

When the provisionally-retaining arm 23 is thus bent outwardly by the retainment release rib 32, the retaining engagement of the lock pawl 232 with the retaining piece portions 121 and 122 is released, so that the lever member 20 can be pivotally moved as shown in FIG. 4*c*.

Thereafter, when the lever member 20 is pivotally moved, each cam pin 31 moves along the associated cam groove 22, so that the male connector 30 is fitted relative to the female connectors 40 and 50 within the connector reception portion 10*a* of the frame member 10.

For disconnecting the male connector 30 from the female connectors 40 and 50, the lever member 20 is pivotally moved in the opposite direction to be returned to the condition of FIG. 1*b*. During this disconnecting operation for the male connector 30, the retainment release rib 32 slidingly passes past the lock pawl 232 and abutment portion 233 of the provisionally-retaining arm 23. However, since the slanting guide surface 32*a* is formed on the retainment release rib 32, the retainment release rib 32 is prevented from being caught by the lock pawl 232 and the abutment portion 233.

In the LIF connector of this embodiment, the space for allowing the bending of the provisionally-retaining arm 23 is provided in the space 123 formed by the retaining piece portions 121 and 122 of the arm reception portion 12, and therefore the provisionally-retaining arm 23, bent or deformed by the retainment release rib 32 when releasing the provisionally-retained condition of the lever member 20, will not engage the side wall of the frame member 10.

Therefore, merely by bending or deforming only the small provisionally-retaining arms 23, the provisional retaining of the lever member 20 can be released positively and smoothly without deforming any member irrelevant to the provisional retaining of the lever member.

Therefore, a fixing portion for being fixed to a vehicle or the like can be provided on any desired portion of the side wall of the frame member 10 without any limitation.

And besides, since the slanting guide surfaces 121*a*, 121*b*, 121*c*, 122*a*, 122*b*, 232*b*, 233*a* and 32*a* are formed on the provisionally-retaining arms 23, the arm reception portion 12 and the retainment release rib 32, the fitting operation (involving the provisional retaining of the lever member 20 and the pivotal movement of the lever 20) for the male connector 30, as well as the disconnecting operation (involving the pivotal movement of the lever member 20 and the provisional retaining of the lever 20) for the male connector 30, can be effected continuously and smoothly.

The LIF connector of the present invention is not limited to the above embodiment.

For example, although the first connector in the above embodiment is the male connector 30 while the second connectors are the female connectors 40, 50, the first connector may be the female connector while the second connector may be the male connector.

In this embodiment, although the male connector 30 and the female connectors 40 and 50 are fitted together through the frame member 10, the invention is not limited to this construction, and the lever member 20 can be pivotally mounted on one of the male and female connectors so that they can be directly fitted together.

As described above, in the LIF connector of the present invention, the provisional retaining of the lever member can be effected and released positively and smoothly without deforming any member irrelevant to the provisional retaining of the lever member, and also the fixing portion for being fixed to a vehicle or the like can be provided without any limitation, and further the connector fitting and disconnecting operations can be effected continuously and smoothly.

What is claimed is:

1. An LIF connector, comprising:

first and second connectors fittable to each other;

a lever member pivotally mounted on the second connector, the lever member being set in a provisionally retaining condition before setting the first connector on the second connector;

a bendable provisionally-retaining arm formed on one of an inner surface of a side wall of the second connector and a side wall of the lever member;

an arm reception portion formed on the other one of the inner surface of the side wall of the second connector and the side wall of the lever member, the arm reception portion retainable the provisionally-retaining arm so as to provisionally retain the lever member, the arm reception portion having a space which is allowable the bending of the provisionally-retaining arm; and a retainment release rib formed on an outer surface of a side wall of the first connector, the retainment release rib bendable the provisionally-retaining arm to release the retaining engagement of the provisionally-retaining arm with the arm reception portion when the first connector is set on the second connector.

2. The LIF connector of claim 1, wherein, the provisionally-retaining arm includes:

a bendable arm body, a lock pawl formed at a distal end of the arm body, and an abutment portion formed on a front surface of the arm body so as to engage the retainment release rib; and the arm reception portion includes two retaining piece portions forming the space for receiving the arm body, and also forming a gap for exposing the abutment portion to the exterior.

3. The LIF connector of claim 2, wherein the two retaining piece portions have an L-shaped cross-section and an inverted L-shaped cross-section, respectively.

4. The LIF connector of claim 2, further comprising:

first surfaces guidable the lock pawl of the provisionally-retaining arm into the space when the lever member is about to be in the provisionally retaining condition; and second surfaces guidable the abutment portion into the gap when the lever member is about to be in the provisionally retaining condition, wherein the first surfaces and the second surfaces are respectively formed on inner edges of the two retaining piece portions of the arm reception portion.

5. The LIF connector of claim 4, wherein the first surfaces and the second surfaces each has a slanting surface.

6. The LIF connector of claim 2, further comprising a third surface formed at a distal end of the lock pawl of the provisionally-retaining arm, the third surface being arranged to be slidable on the inner edges of the retaining piece portions so as to guide the lock pawl into the space when the lever member is about to be in the provisionally retaining condition.

7. The LIF connector of claim 6, wherein the third surface has a slanting surface.

8. The LIF connector of claim 2, further comprising a fourth surface formed at an end of the abutment portion of the provisionally-retaining arm, the fourth surface being arranged to be slidable on the retainment release rib so as to guide the retainment release rib to the abutment portion when the first connector is set on the second connector.

9. The LIF connector of claim 8, wherein the fourth surface has a slanting surface.

10. The LIF connector of claim 8, further comprising a fifth surface formed on the retainment release rib, the fifth surface being arranged to be slidable on a distal end of the lock pawl of the provisionally-retaining arm so as to guide the retainment release rib to the abutment portion of the provisionally-retaining arm when disconnecting the first connector from the second connector.

11. An LIF connector, comprising:

a frame member receivable a second connector;

a lever member pivotally mounted on the frame member;

a first connector fittable to the second connector through the frame member, wherein the lever member is set in a provisionally retaining condition before setting the first connector on the frame member;

a bendable provisionally-retaining arm formed on one of an inner surface of a side wall of the frame member and a side wall of the lever member;

an arm reception portion formed on the other one of the inner surface of the side wall of the frame member and the side wall of the lever member, the arm reception portion retainable the provisionally-retaining arm so as to provisionally retain the lever member, the arm reception portion having a space which is allowable the bending of the provisionally-retaining arm; and a retainment release rib formed on an outer surface of a side wall of the first connector, the retainment release rib bendable the provisionally-retaining arm to release the retaining engagement of the provisionally-retaining arm with the arm reception portion when the first connector is set on the frame member.

12. The LIF connector of claim 11, wherein, the provisionally-retaining arm includes:

a bendable arm body, a lock pawl formed at a distal end of the arm body, and an abutment portion formed on a front surface of the arm body so as to engage the retainment release rib; and the arm reception portion includes two retaining piece portions forming the space for receiving the arm body, and also forming a gap for exposing the abutment portion to the exterior.

13. The LIF connector of claim 12, wherein the two retaining piece portions have an L-shaped cross-section and an inverted L-shaped cross-section, respectively.

14. The LIF connector of claim 12, further comprising:

first surfaces guidable the lock pawl of the provisionally-retaining arm into the space when the lever member is about to be in the provisionally retaining condition; and second surfaces guidable the abutment portion into the gap when the lever member is about to be in the provisionally retaining condition, wherein the first surfaces and the second surfaces are respectively formed on inner edges of the two retaining piece portions of the arm reception portion.

15. The LIF connector of claim 14, wherein the first surfaces and the second surfaces each has a slanting surface.

16. The LIF connector of claim 12, further comprising a third surface formed at a distal end of the lock pawl of the provisionally-retaining arm, the third surface being arranged to be slidable on the inner edges of the retaining piece portions so as to guide the lock pawl into the space when the lever member is about to be in the provisionally retaining condition.

17. The LIF connector of claim 16, wherein the third surface has a slanting surface.

18. The LIF connector of claim 12, further comprising a fourth surface formed at an end of the abutment portion of the provisionally-retaining arm, the fourth surface being arranged to be slidable on the retainment release rib so as to guide the retainment release rib to the abutment portion when the first connector is set on the frame member.

19. The LIF connector of claim 18, wherein the fourth surface has a slanting surface.

20. The LIF connector of claim 18, further comprising a fifth surface formed on the retainment release rib, the fifth surface being arranged to be slidable on a distal end of the lock pawl of the provisionally-retaining arm so as to guide the retainment release rib to the abutment portion of the provisionally-retaining arm when detaching the first connector from the frame member.

* * * * *